United States Patent [19]

Lyu et al.

[11] 3,942,673

[45] Mar. 9, 1976

[54] WALL CONSTRUCTION FOR CONTAINERS

[75] Inventors: Seung W. Lyu, Homewood; Donald Martin, Rolling Meadows, both of Ill.

[73] Assignee: National Can Corporation, Chicago, Ill.

[22] Filed: May 10, 1974

[21] Appl. No.: 468,817

[52] U.S. Cl. ..... 220/66; 220/70

[51] Int. Cl.[2] ..... B65D 1/12

[58] Field of Search ..... 220/3, 66, 67, 69, 70, 220/73, 74

[56] References Cited

UNITED STATES PATENTS

| | | | |
|---|---|---|---|
| 3,434,626 | 3/1969 | Kinslow, Jr. | 220/66 |
| 3,608,774 | 9/1971 | Saunders | 220/67 |
| 3,693,828 | 9/1972 | Kneusel et al. | 220/70 X |
| 3,730,383 | 5/1973 | Dunn et al. | 220/70 X |

*Primary Examiner*—William Price
*Assistant Examiner*—Stephen Marcus
*Attorney, Agent, or Firm*—James E. Anderson

[57] ABSTRACT

A drawn and ironed container with a profiled bottom wall is disclosed herein. The profiled bottom wall includes an ellipsoidal dome surrounded by a substantially vertical wall portion which merges with the side wall of the container along an outwardly directed bead. The configuration of the bottom wall substantially increases the resistance to buckling when the container is filled with pressurized product.

10 Claims, 2 Drawing Figures

WALL CONSTRUCTION FOR CONTAINERS

BACKGROUND OF THE INVENTION

In the manufacture of drawn, extruded and/or ironed containers, one of the problems encountered is to incorporate sufficient rigidity into the bottom wall of the container to prevent buckling when the container is used for packaging pressurized products, such as carbonated beverages.

The most ideal type of container bottom wall would be a flat wall which would allow for maximum capacity for a given container with a minimum height. However, such a container is not economically feasible because the thickness of the wall would have to be of such magnitude that the cost of the container would be prohibitive.

One method that has been employed for maintaining sufficient rigidity with thin metals is to form the bottom wall into a spherical dome configuration. This configuration is generally shown in U.S. Pat. No. 3,760,751. While this configuration allows container manufacturers to somewhat reduce the metal thickness, these manufacturers are continuously working on techniques that will allow for further reduction in metal thickness without sacrificing container rigidity.

Since containers are produced and sold by the billions annually, manufacturers are constantly striving to reduce the wall thickness of the container while still maintaining the same operating characteristics. Because of the large volume, it will be appreciated that a small reduction in metal thickness, even on the order of one thousandth of an inch, will reduce manufacturing costs substantially.

While some small amount of buckling of the bottom wall is tolerable, if the buckle is noticeable, a customer will usually assume that the contents of the can are spoiled which results in substantial waste. It will be appreciated that when packaging pressurized materials, such as beer or other carbonated beverages, the pressure in the container may exceed 50 p.s.i. when the container is stored and subjected to normal summer temperatures and must also be capable of withstanding 90 p.s.i. minimum during the pasteurization process.

SUMMARY OF THE INVENTION

According to the present invention, a cylindrical container having a cylindrical side wall and a bottom wall is formed so that the bottom wall is capable of withstanding pressures on the order of 90 p.s.i. minimum while still reducing the thickness of the container wall by more than 10 percent of the thickness of present day commercially competitive containers for the same product.

The cylindrical container has a side wall and a bottom wall integral therewith at one end thereof with the bottom wall consisting of a substantially vertical portion extending upwardly toward the opposite end and an ellipsoidal dome within the vertical portion.

The ellipsoidal dome is profiled in such a way that the maximum stress point on the ellipsoidal dome is located at the intersection of the dome with the vertical portion. Also, the lower end of the cylindrical wall merges with an outwardly directed bead along an arcuate portion so that the diameter of the bottom wall is smaller than the outside diameter of the container.

The ellipsoidal dome is formed with compound radii which have dimensions that are proportionate to the diameter of the cylindrical side wall. In addition, the height of the vertical portion is proportionate to the overall height of the bottom wall to further increase the strength to buckling resistance of the bottom wall.

DETAILED DESCRIPTION

Figure 1:
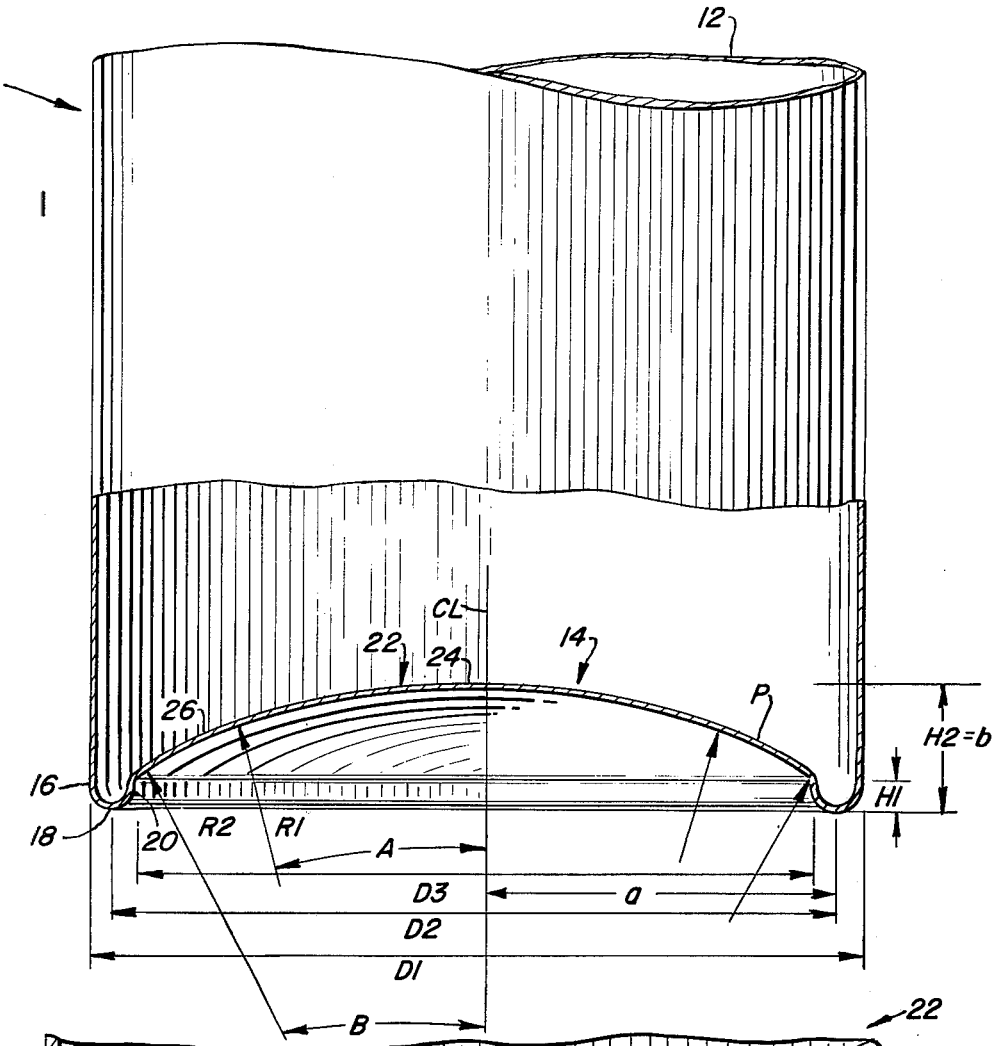
FIG. 1 is a fragmentary side elevation, partly in section, showing the container of the present invention.
Figure 2:
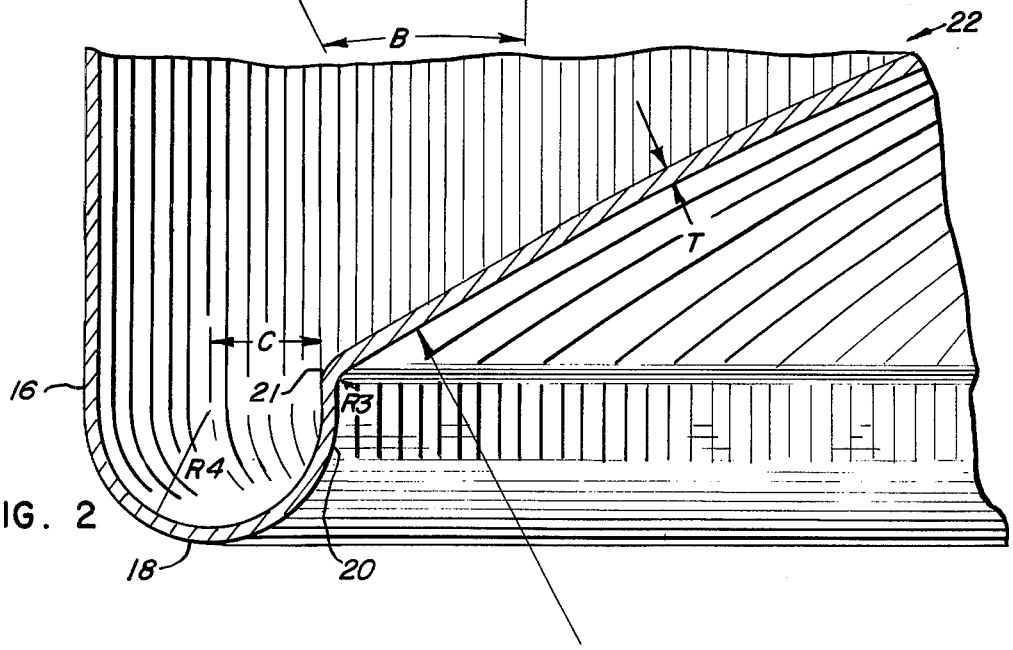
FIG. 2 is an enlarged fragmentary sectional view of the area between the side and bottom wall of the container shown in FIG. 1.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings discloses the lower portion of a container 10 that is formed of metal, such as steel or aluminum. Container 10 has a circular or cylindrical side wall 12 integral with bottom wall 14. Side and bottom walls 12 and 14 are formed by drawing and ironing a single piece of steel or aluminum into a specific configuration that will be described later. The upper end of the container or can body (not shown) is also deformed so that an end can be seamed thereto. Since this portion of the container forms no part of the invention, the upper end of the container has been deleted.

According to the present invention, the bottom wall or panel 14 is specifically configured to be capable of withstanding substantial internal pressure without deforming or buckling.

The structural arrangement of the container side wall 12 and bottom wall 14 will first be described and the advantages of the various structural features will then be summarized. Cylindrical side wall 12 is joined to bottom wall 14 through an arcuate portion 16 having a progressively decreasing radius which merges with the bottom wall through an annular outwardly directed bead 18. Bottom wall 14 has a substantially vertical portion 20 at the inner end of bead 18. The upper end of substantially vertical portion 20 merges along a radiused portion 21 with an upwardly extending ellipsoidal dome 22. Dome 22 has a first spherical portion 24 and an annular portion 26 which merge with each other at juncture P.

Spherical portion 24 has a radius R1 having its center located on the center line CL of container 10. Annular portion 26 has a constant curvature in cross section which has a second radius R2 having its center located in close proximity to the point of intersection between R2 and R1.

Radius R1 or the first radius for ellipsoidal dome 24 defines an angle A with the center line CL at the periphery of spherical portion 24 while the radius R2 at the periphery of annular portion 26 defines an angle B with respect to the center line CL of the container. The periphery of annular portion 26 merges with substantially vertical portion 20 along arcuate portion 21 which has a radius R3 while the lower end of substantially vertical portion 20 merges with arcuate portion 16 through bead 18 that has a radius R4. The substantially vertical portion 20 defines an angle C with respect to a plane extending parallel to side wall 12.

With the configuration of the bottom end of the container as described above, container bottom wall 22 has a diameter D2 (as measured at the bottom edge or lowermost point of bead 18) which is smaller than the diameter D1 of the periphery of side wall 12. In addition, ellipsoidal dome 22 has a diameter D3 (measured from the point of merger with annular portion 26 substantially vertical portion 20) which is slightly smaller than the diameter D2 of bottom wall 14. Also, substantially vertical portion 20 has a vertical height H1 which is proportionate to the overall height H2 of bottom wall 14, as will be described later.

It has been found that the relation of H1 to H2 and the particular configuration of ellipsoidal dome 22 are the most important variables in the profiled bottom wall of container 10 to produce a container which is highly resistant to pressure buckling. Stated another way, the ellipsoidal dome 22 and substantially vertical wall 20 are dimensioned so that the maximum stress point on the ellipsoidal dome is located at the intersection between substantially vertical portion 20 and dome 22. In addition, the arcuate portion 16 at the lower end of side wall 12 and the annular bead 18 produce a reduced diameter for bottom wall 14. The diameter for bottom wall 14 is defined by the lowermost edge of bead 18 and this annular edge produces the anchor point or base for bottom wall 14 when pressure is applied inside the container.

It has been discovered that a significant stiffening action or resistance to buckling can be produced by having the dimensions described above within the following ranges:

| Dimensions | Ranges |
|---|---|
| D1 = Outside Diameter of Container | |
| T = Metal Thickness | |
| D2 | 0.85 to 0.95 D1 |
| D3 | 0.80 to 0.90 D2 |
| a (semi-major axis) | 0.45 to 0.55 D2 |
| b (semi-minor axis) | 0.30 to 0.40 a |
| H2 | b |
| H1 | 0.20 to 0.30 H2 |
| R3 | 1.0 to 2.0 T |
| R4 | 3.0 to 4.0 T |
| A | 10° to 30° |
| B | 30° to 40° |
| C | 0° to 20° |

With the various dimensions in the above ranges, the first and second radii are determined from the following formulas:

$$R1 = \frac{a^2}{\sqrt{(a^2 \sin^2 A + b^2 \cos^2 A)}}$$

$$R2 = \frac{a^2 b^2}{(\sqrt{(a^2 \sin^2 A + b^2 \cos^2 A)})^3}$$

It has been determined that the buckling resistance can be increased by 40 percent when utilizing an ellipsoidal dome rather than a conventional spherical dome.

While the invention is not limited to any specific dimensions, a container with the following dimensions resulted in increased resistance to buckling over a standard spherical dome:

D2 = 0.9 D1 R3 = 1.5T

-continued

D3 = 0.85 D1 R4 = 3.5T
a = 0.5 D2 A = 20°
b = 0.333a B = 35°
H1 = 0.25 H2 C = 3°
H2 = b with R1 and R2 determined by the above formulas.

It will be appreciated that a container constructed in accordance with the teachings of the present invention will allow the manufacturer to reduce the metal thickness without sacrificing rigidity or substantially increase the resistance to buckling when using a material having a thickness corresponding to what is presently used for these types of containers.

What is claimed is:

1. A container having a cylindrical side wall and an integral bottom wall at the lower end thereof, said bottom wall and side wall being joined by an annular outwardly directed bead having one end joined to said side wall and an opposite end, said bottom wall having an ellipsoidal dome within said opposite end of said bead, said ellipsoidal dome having a central spherical portion defining a first radius having its center located on the center line of the container, said ellipsoidal dome having an annular portion surrounding said spherical portion, said annular portion having a second radius which is less than said first radius, and a substantially vertical portion between the outer periphery of said annular portion and said opposite end of said bead.

2. A container as defined in claim 1, in which said side wall has an arcuate lower end merging with said one end of said bead.

3. A container as defined in claim 1, in which the vertical dimension between the lower edge of said bead and the upper edge of said vertical portion is in the range of 0.2 to 0.3 times the vertical dimension of said bottom wall at the center line of said container.

4. A container as defined in claim 1, in which said first radius defines a first angle of less than 30° with respect to the center line at the periphery of said spherical portion and said second radius defines a second angle of less than 40° with respect to the center line at the periphery of said annular portion.

5. A container as defined in claim 4, in which said first radius is determined by the following formula:

$$R1 = \frac{a^2}{\sqrt{(a^2 \sin^2 A + b^2 \cos^2 A)}}$$

where (b) is the axial dimension of said bottom wall at the center line of said container, (a) is one-half the diameter of said bottom wall and (A) is said first angle.

6. A container as defined in claim 5, in which said second radius is determined by the following formula:

$$R2 = \frac{a^2 b^2}{(\sqrt{(a^2 \sin^2 A + b^2 \cos^2 A)})^3}.$$

7. A container as defined in claim 6, in which said side wall has an arcuate lower end merging with said one end of said bead and in which a lowermost edge of said outwardly directed bead has a diameter which is 0.85 to 0.95 times the outside diameter of said side wall.

8. A container as defined in claim 7, in which said substantially vertical portion is substantially flat and defines an angle of less than 10° with respect to said side wall and in which the juncture between said dome and said vertical portion has a diameter which is 0.80 to 0.90 times the outside diameter of said side wall.

9. A container as defined in claim 8, in which said outwardly directed bead has a radius which is 3 to 4 times the thickness of said bottom wall.

10. A container as defined in claim 9, in which the juncture between said dome and said vertical portion is curved and has a radius which is 1 to 2 times the thickness of said bottom wall.

* * * * *